US012421646B2

(12) United States Patent
Balinksi et al.

(10) Patent No.: US 12,421,646 B2
(45) Date of Patent: Sep. 23, 2025

(54) CONTROLLED MOISTURE REMOVAL IN A LAUNDRY TREATING APPLIANCE

(71) Applicant: WHIRLPOOL CORPORATION, Benton Harbor, MI (US)

(72) Inventors: Barbara A. Balinksi, Saint Joseph, MI (US); Floyd G. Jackson, Baroda, MI (US); Karl David McAllister, Stevensville, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 18/488,540

(22) Filed: Oct. 17, 2023

(65) Prior Publication Data

US 2024/0044068 A1 Feb. 8, 2024

Related U.S. Application Data

(60) Division of application No. 17/532,063, filed on Nov. 22, 2021, now Pat. No. 11,913,160, which is a (Continued)

(51) Int. Cl.
*D06F 25/00* (2006.01)
*D06F 34/18* (2020.01)
(Continued)

(52) U.S. Cl.
CPC ..... *D06F 39/04* (2013.01); *D06F 58/38* (2020.02); *D06F 25/00* (2013.01); *D06F 34/18* (2020.02);
(Continued)

(58) Field of Classification Search
None
See application file for complete search history.

(56) References Cited

U.S. PATENT DOCUMENTS 3,286,364 A 11/1966 Morrison et al.
3,399,461 A 9/1968 Doty
(Continued)

FOREIGN PATENT DOCUMENTS

CN 201473777 U 5/2010
CN 211368095 U 8/2020
(Continued)

OTHER PUBLICATIONS

Samsung Smart Washer & Dryer User Manual DV457, Cell Phone App, Date Unknown, http://itunes.apple.com/tr/app/samsung-smart-washer-dryer/id519077318?mt=8 Part 1 of 2.
(Continued)

*Primary Examiner* — Levon J Shahinian
(74) *Attorney, Agent, or Firm* — Brooks Kushman, P.C.

(57) ABSTRACT

A method of operating a laundry treating appliance for treating laundry according to a treating cycle of operation. The laundry treating appliance comprises a treating chamber for receiving the laundry that is selectively accessible through a door movable between opened and closed positions. The method comprises determining at the end of a laundry treating cycle whether the door has been opened and subsequently reclosed and reducing humidity in the treating chamber after the determination that the door has been reclosed.

12 Claims, 4 Drawing Sheets

Related U.S. Application Data continuation of application No. 16/845,183, filed on Apr. 10, 2020, now Pat. No. 11,208,755, which is a continuation of application No. 15/907,378, filed on Feb. 28, 2018, now Pat. No. 10,633,776, which is a division of application No. 15/602,157, filed on May 23, 2017, now Pat. No. 9,945,062, which is a continuation of application No. 14/818,394, filed on Aug. 5, 2015, now Pat. No. 9,689,100, which is a division of application No. 12/545,115, filed on Aug. 21, 2009, now Pat. No. 9,109,317.

(51) Int. Cl.

| | |
|---|---|
| ***D06F 34/20*** | (2020.01) |
| ***D06F 39/04*** | (2006.01) |
| ***D06F 58/38*** | (2020.01) |
| *D06F 101/00* | (2020.01) |
| *D06F 103/02* | (2020.01) |
| *D06F 103/08* | (2020.01) |
| *D06F 103/36* | (2020.01) |
| *D06F 103/40* | (2020.01) |
| *D06F 105/12* | (2020.01) |
| *D06F 105/22* | (2020.01) |
| *D06F 105/24* | (2020.01) |
| *D06F 105/28* | (2020.01) |
| *D06F 105/30* | (2020.01) |

(52) U.S. Cl.

CPC ..... *D06F 34/20* (2020.02); *D06F 2101/00* (2020.02); *D06F 2103/02* (2020.02); *D06F 2103/08* (2020.02); *D06F 2103/36* (2020.02); *D06F 2103/40* (2020.02); *D06F 2105/12* (2020.02); *D06F 2105/22* (2020.02); *D06F 2105/24* (2020.02); *D06F 2105/28* (2020.02); *D06F 2105/30* (2020.02)

(56) References Cited

U.S. PATENT DOCUMENTS

| | | | | |
|---|---|---|---|---|
| 4,649,654 | A * | 3/1987 | Hikino | D06F 58/50 34/493 |
| 5,050,313 | A | 9/1991 | Wakaeya et al. | |
| 5,237,256 | A | 8/1993 | Bashark | |
| 5,588,313 | A | 12/1996 | Hildebrand | |
| 6,497,121 | B1 | 12/2002 | Walsh et al. | |
| 7,272,961 | B2 | 9/2007 | Jeong | |
| 7,603,878 | B2 | 10/2009 | Fyvie | |
| 7,934,400 | B2 | 5/2011 | Yoo et al. | |
| 8,272,144 | B2 | 9/2012 | Arreghini | |
| 8,984,692 | B2 | 3/2015 | Balinski et al. | |
| 9,109,317 | B2 | 8/2015 | Balinski et al. | |
| 9,146,475 | B2 | 9/2015 | Graupner et al. | |
| 10,633,776 | B2 | 4/2020 | Balinski et al. | |
| 11,053,630 | B2 | 7/2021 | Islas et al. | |
| 11,208,755 | B2 | 12/2021 | Balinski et al. | |
| 2003/0028258 | A1 | 2/2003 | Peterson | |
| 2005/0132755 | A1 | 6/2005 | Sundell et al. | |
| 2005/0262883 | A1 | 12/2005 | Yang et al. | |
| 2006/0101588 | A1 | 5/2006 | Park et al. | |
| 2007/0113421 | A1* | 5/2007 | Uhara | D06F 25/00 34/275 |
| 2008/0053163 | A1 | 3/2008 | Park et al. | |
| 2008/0078209 | A1 | 4/2008 | Kim et al. | |
| 2008/0295696 | A1 | 12/2008 | Kim | |
| 2009/0071032 | A1 | 3/2009 | Kreutzfeldt et al. | |
| 2010/0115790 | A1 | 5/2010 | Arreghini | |
| 2010/0146712 | A1 | 6/2010 | Finch et al. | |
| 2011/0030238 | A1 | 2/2011 | Nawrot et al. | |
| 2011/0041260 | A1 | 2/2011 | Balinski et al. | |
| 2011/0041562 | A1 | 2/2011 | Balinski et al. | |
| 2012/0284930 | A1 | 11/2012 | Robertson et al. | |
| 2012/0304396 | A1 | 12/2012 | Dale et al. | |
| 2013/0192084 | A1 | 8/2013 | Hill et al. | |
| 2013/0321136 | A1 | 12/2013 | Park et al. | |
| 2015/0191863 | A1 | 7/2015 | Kim et al. | |
| 2016/0244904 | A1 | 8/2016 | Broitzman | |
| 2017/0254009 | A1 | 9/2017 | Balinski et al. | |
| 2019/0218701 | A1 | 7/2019 | Strait | |
| 2020/0283944 | A1 | 9/2020 | Islas et al. | |
| 2021/0032794 | A1 | 2/2021 | Strait | |
| 2022/0106722 | A1 | 4/2022 | Holzen et al. | |
| 2022/0356635 | A1 | 11/2022 | Yoon et al. | |

FOREIGN PATENT DOCUMENTS

| | | | |
|---|---|---|---|
| CN | 113969489 | A | 1/2022 |
| CN | 215887610 | U | 2/2022 |
| DE | 4011507 | A1 | 12/1991 |
| DE | 4100642 | A1 | 7/1992 |
| DE | 29622066 | U1 | 4/1998 |
| DE | 102004021019 | A1 | 11/2005 |
| DE | 102007041875 | A1 | 7/2008 |
| DE | 102010039182 | A1 | 2/2012 |
| EP | 0816548 | A2 | 1/1998 |
| EP | 2050863 | A1 | 4/2009 |
| EP | 1852543 | B1 | 2/2010 |
| JP | H04144531 | A | 5/1992 |
| JP | 2000000391 | A | 1/2000 |
| JP | 2007105238 | A | 4/2007 |
| JP | 2009232888 | A | 10/2009 |
| KR | 20050066329 | A | 6/2005 |
| KR | 20060039194 | A | 5/2006 |
| KR | 101054413 | B1 | 8/2011 |
| WO | 2009035305 | A2 | 3/2009 |
| WO | 2013066857 | A1 | 5/2013 |
| WO | 2018121942 | A1 | 7/2018 |
| WO | 2019100860 | A1 | 5/2019 |
| WO | 2019228244 | A1 | 12/2019 |
| WO | 2022068946 | A1 | 4/2022 |
| WO | 2023284720 | A1 | 1/2023 |
| WO | 2023054861 | A1 | 4/2023 |

OTHER PUBLICATIONS

Samsung Smart Washer & Dryer User Manual DV457, Cell Phone App, Date Unknown, http://itunes.apple.com/tr/app/samsung-smart-washer-dryer/id519077318?mt=8 Part 2 of 2.

Owner's Manual and Installation Instructions Kenmore Three-Speed with Options and Speeds Switch Automatic Washers (https://c.searspartsdirect.com/doc/L0305286) (Year: 1998).

* cited by examiner

CONTROLLED MOISTURE REMOVAL IN A LAUNDRY TREATING APPLIANCE

CROSS-REFERENCE TO RELATED APPLICATIONS

This application is a division of U.S. application Ser. No. 17/532,063 filed Nov. 22, 2021, which is a continuation of U.S. application Ser. No. 16/845,183 filed Apr. 10, 2020, which is a continuation of U.S. application Ser. No. 15/907,378 filed Feb. 28, 2018, now U.S. Pat. No. 10,633,776, issued Apr. 28, 2020, which is a division of U.S. application Ser. No. 15/602,157 filed May 23, 2017, now U.S. Pat. No. 9,945,062, issued Apr. 17, 2018, which is a continuation of U.S. application Ser. No. 14/818,394 filed Aug. 5, 2015, now U.S. Pat. No. 9,689,100, issued Jun. 27, 2017, which is a division of U.S. application Ser. No. 12/545,115 filed Aug. 21, 2009, now U.S. Pat. No. 9,109,317, issued Aug. 18, 2015, the disclosures of which are hereby incorporated in their entirety by reference herein.

BACKGROUND OF THE INVENTION

Laundry treating appliances, such as clothes washers, clothes dryers, refreshers, and non-aqueous systems, have a treating chamber, which may have a configuration of a rotating drum, in which laundry items are placed for treating according to a cycle of operation. The laundry treating appliance may have a controller communicably and operably connected with the various components of the appliance for controlling the appliance to execute the cycle of operation. The cycle of operation may be selected manually by the user or automatically based on one or more conditions determined by the controller.

After the completion of the cycle of operation, the laundry may still contain moisture and/or there still may be moisture within the treating chamber or other areas of the appliance. If the moisture-laden laundry is left in the treating chamber too long, it may begin to mold or mildew, which may create a sour smell that most users find unpleasant. The moisture remaining within the treating chamber or other areas of the appliance may cause a similar result.

BRIEF DESCRIPTION OF THE INVENTION

Aspects of the disclosure relate to a method of operating a laundry treating appliance for treating laundry according to a treating cycle of operation. The laundry treating appliance comprises a treating chamber for receiving the laundry that is selectively accessible through a door movable between opened and closed positions. The method comprises determining at the end of a laundry treating cycle whether the door has been opened and subsequently reclosed and reducing humidity in the treating chamber after the determination that the door has been reclosed.

In another aspect, the disclosure relates to a method of operating a laundry treating appliance for treating laundry according to a treating cycle of operation. The laundry treating compliance comprises a treating chamber for receiving the laundry, which is selectively accessible through a door movable between opened and closed positions. The method comprises determining a removal of laundry from the treating chamber after a completion of the treating cycle of operation and reducing humidity in the treating chamber after the determination of the removal of the laundry.

DESCRIPTION OF EMBODIMENTS OF THE INVENTION

Figure 1:
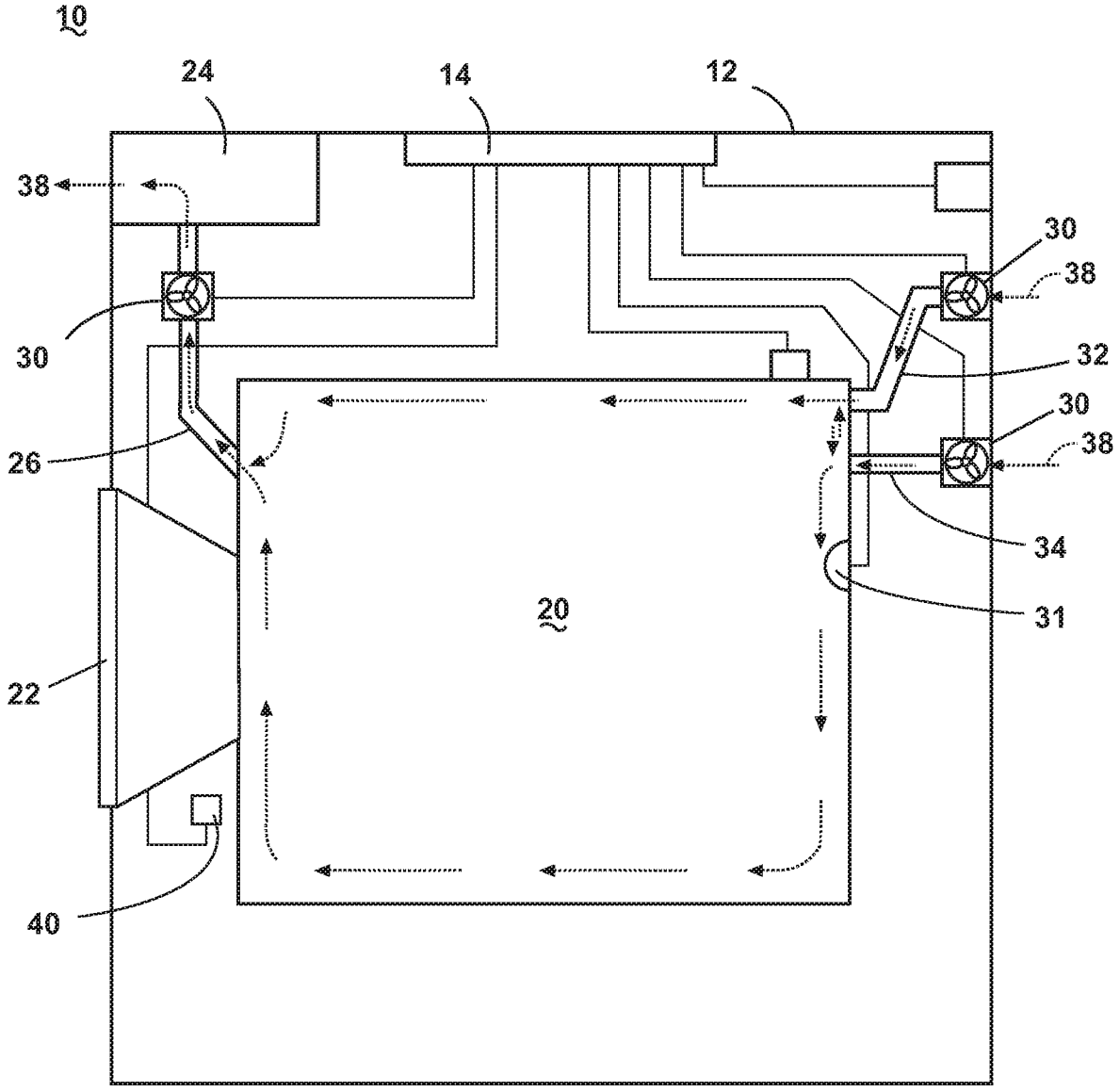
FIG. 1 is a schematic view of a laundry treating appliance according to a first embodiment of the invention.

Referring now to the drawings, wherein like numerals indicate like elements throughout the views, FIG. 1 illustrates one embodiment of a laundry treating appliance according to the invention. The laundry treating appliance 10 according to the invention may be any appliance which performs a cycle of operation on laundry, non-limiting examples of which include a horizontal or vertical axis clothes washer, a combination washing machine and dryer, a tumbling or stationary refreshing/revitalizing machine, an extractor, a non-aqueous washing apparatus, and a revitalizing machine.

The laundry treating appliance 10 may comprise a cabinet 12 in having a controller 14 for controlling the operation of the laundry treating appliance 10 to complete a cycle of operation. A treating chamber 20 may be located within the cabinet 12 for receiving laundry to be treated during a cycle of operation. The treating chamber has an open face that may be selectively closed by a door 22. A treatment dispenser 24 may be fluidly coupled with the treating chamber 20 through a dispensing conduit 26 and operably coupled to the controller 14 to deliver a treatment chemistry to the treating chamber 20 during a cycle of operation in response to instructions from the controller.

The laundry treating appliance 10 may further include one or more humidity reduction device, which is illustrated as a fan 30 and/or a heat source 31, for dehumidifying the air within the laundry treating appliance 10. While the humidity reduction device is illustrated as a fan 30 and/or a heat source 31, the humidity reduction device may be any device capable of dehumidifying the air within the laundry treating appliance 10. The humidity reduction device may dehumidify the air within the treating chamber 20 by venting and/or supplying air from the exterior of the treating chamber 20 to the interior of the treating chamber 20, or may dehumidify the air within the treating chamber 20 by heating air in the treating chamber 20. The heat source 31 may be, for example, in a form of an electric heating element, an incandescent bulb or other type of bulb. An additional example of the humidity reduction device includes an evaporator, a condenser or an air cooler. Any of these devices may be used alone or in combination with another type of device. As used herein, the term dehumidify may refer to both removing moisture from the air, replacing the air with less humid air, and drying a surface as a result of removal of moisture and moisture-laden air from the surface and surrounding environment. An operation of the humidity reduction device may be continuous or discontinuous.

The number and location of the humidity reduction device may be selected to achieve the desired flow of air through the treating chamber 20 and level of dehumidification. As illustrated in FIG. 1, one example of a suitable location for the humidity reduction device, such as the fan 30, is the dispensing conduit 26. The humidity reduction device may be located within the dispensing conduit 26 for drawing air from the exterior of the treating chamber 20, including exterior of the laundry treating appliance 10, through the treatment dispenser 24 and into the treating chamber 20. The treatment dispenser 24 may be open to the ambient air surrounding the laundry treating appliance 10 such that the humidity reduction device may draw in or exhaust air from the treating chamber 20 through the treatment dispenser 24.

In another example, the humidity reduction device may be located within a child safety vent 32 that may exhaust to a rear side of the laundry treating appliance 10. The humidity reduction device can be attached to either front or back location of the tub 16 or the treating chamber 20. Thus air for circulation can be obtained from within the cabinet 12. In yet another example, the humidity reduction device may be coupled with the treating chamber 20 through a separate dehumidifying conduit 34. The location of the humidity reduction device may be selected to dry certain surfaces within the treating chamber 20 that are not normally cleaned during the wash process, such as the surfaces above the water fill line 36. One or more humidity reduction devices may be coupled with the treatment chamber 20 such that air flows to these locations to ensure drying of these surfaces. Also, one or more humidity reduction devices in a form of the heat source 31 may be attached to the treatment chamber 20 such that air is heated to ensure drying of these surfaces. The one or more heat sources 31 may be located virtually anywhere in the treatment chamber 20 or anywhere in the cabinet 12, provided that the heater air will be supplied to the treating chamber 20.

As illustrated by the arrows 38 in FIG. 1, one or more of the humidity reduction devices, such as the fan 30 may be operated such that air is drawn in from the exterior of the laundry treating appliance 10 through a vent tube 33 (shown in FIG. 2) and into the treating chamber 20 to replace the air within the treating chamber 20. The vent tube 33 may be the child safety vent 32, the dehumidifying conduit 34 or any other conduit in the cabinet 12. The air from within the treating chamber 20 may then be exhausted to the front of the laundry treating appliance 10 through the treatment dispenser 24. The dispensing conduit 26, the child safety vent 32 and/or dehumidifying conduit 34 may be provided with a humidity reduction device either alone or in combination to facilitate the flow of air through the treating chamber 20.

A humidity reduction device 30 may also be provided within the dispensing conduit 26 to facilitate the movement of air from the exterior of the laundry treating appliance 10 through the treatment dispenser 24. The process may also be operated in reverse such that air is drawn in through the treatment dispenser 24 and exhausted through the child safety vent 32 and/or dehumidifying conduit 34. For example, the humidity reduction device 30 within the child safety vent 32 may be operated to draw air from the exterior of the laundry treating appliance 10 through the treatment dispenser 24 and dispensing conduit 32 into the treating chamber 20, where it may then be exhausted through the child safety vent 32.

Alternatively, or additionally, an additional inlet air (not shown) can be obtained from the cabinet 12 space and/or the exit air can be vented into the cabinet 12 space instead of exiting to the exterior of the laundry treating appliance 10.

In addition, the laundry treating appliance 10 may include one or more interior door sensors 40 for sensing the door 22 position. The one or more door sensors 40 may be of any suitable absolute or relative (displacement) position sensor or a combination of sensors, capable of determining between the door 22 being in opened and closed positions. Some non-limiting examples are: an inductive sensor, a Hall effect sensor, an optic or infrared sensor, a capacitive sensor, a resistive sensor or a mechanical pressure sensor. The optical sensor may have a light or other electromagnetic radiation emitting and detecting means for determining if the door 22 is open or closed. In another example, the door sensor 22 may be in the form of an imaging device, such as a camera, that is capable of determining if the door 22 is open or closed.

The door sensor 40 may be located in any suitable location within the laundry treating appliance 10, for example it may be located in the cabinet 12 or within the door 22. As illustrated in FIG. 1, the door position sensor 40 is located within the cabinet 12 in a close proximity to the door 22. It is within the scope of the invention for multiple door sensors 40 to be located at multiple locations within the laundry treating appliance 10.

The door sensor 40 may be used as a laundry sensor, because, it may be assumed that the laundry is still in the chamber 20 if the door 22 is determined to be closed after completion of the treating cycle of operation. It may also be assumed, that the laundry was removed upon determination of the opening of the door 22 after the completion of the treating cycle of operation.

Alternatively, or additionally, one or more special laundry sensors 41 (FIG. 3) may be provided to indicate presence or absence of the laundry in the treating chamber. The one or more laundry sensors 41 may be located in any suitable location within the laundry treating appliance 10, and may be of any suitable type. Some non-limiting examples of a suitable laundry sensor are: an optical sensor, infrared sensor, pressure sensor, weight sensor, or a camera.

The controller 14 may be operably coupled with one or more components of the laundry treating appliance 10 for communicating with and controlling the operation of the component to complete a cycle of operation. For example, the controller 14 may be coupled with the treatment dispenser 24 for dispensing a treatment during a cycle of operation and the humidity reduction device for dehumidifying the treating chamber 20.

The controller 14 may also be coupled with the door sensor 40 for determining the door 22 position. The sensor reading or readings may be in a form of an analog, digital, continuous, or discontinuous signal and may be sent to the controller 14. The controller 14 may then determine whether to activate or deactivate the humidity reduction device for a predetermined time based on the determined door 22 position.

Figure 2:
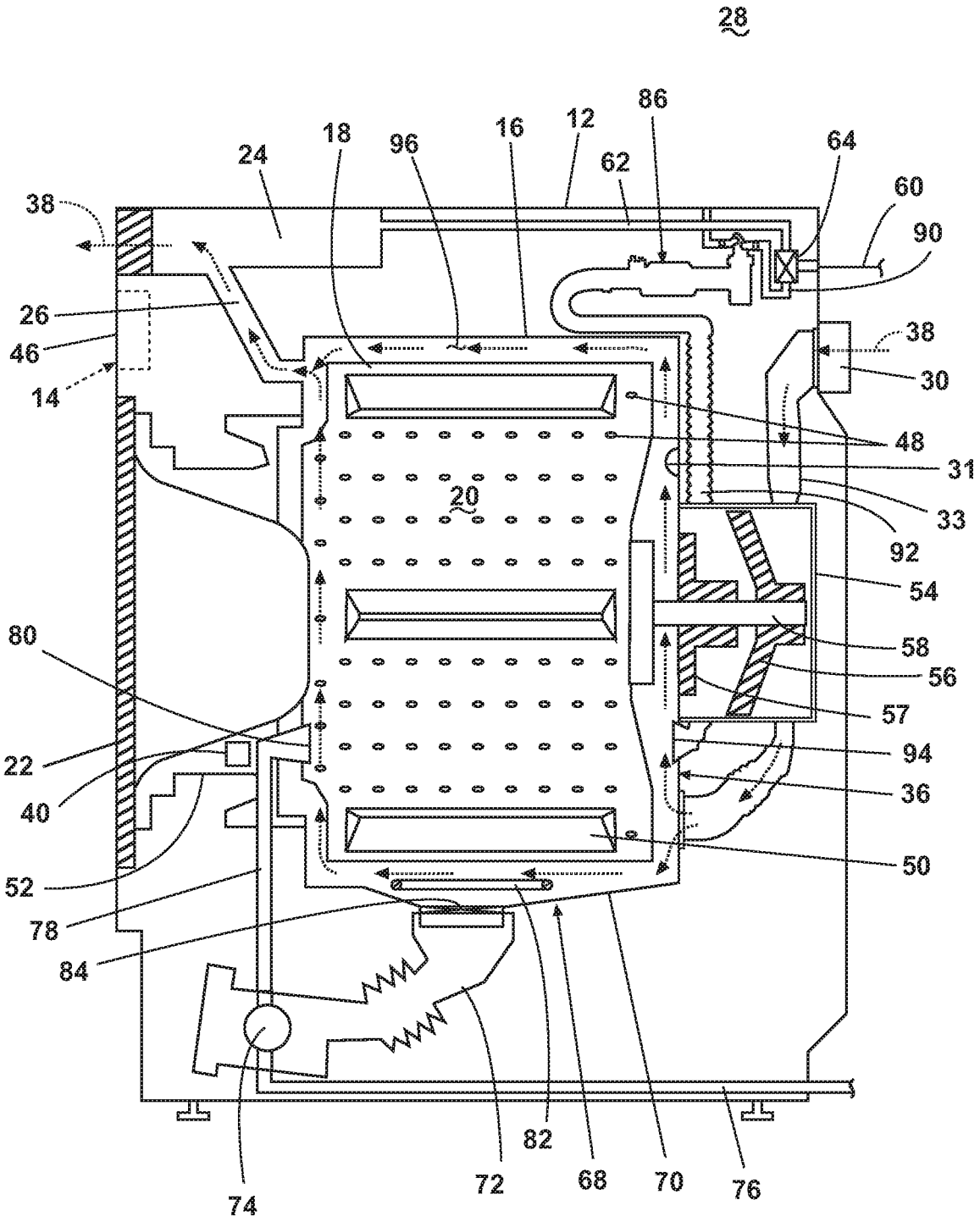
FIG. 2 is a schematic view of a laundry treating appliance according to a second embodiment of the invention.

FIG. 2 illustrates a second embodiment of the invention in the form of a washing machine 28 which is similar in structure to the laundry treating appliance 1 described above. Therefore, like parts will be identified with the same numerals. The washing machine 28 described herein shares many features of a traditional automatic washing machine, which will not be described in detail except as necessary for a complete understanding of the invention.

The washing machine 28 may have a user interface 46 for selecting a cycle of operation and couple with the controller 14 for controlling the operation of the washing machine 28 to implement the selected cycle of operation. An imperforate tub 16 and a perforated drum 18 may be located within the interior of the cabinet 12. The tub 16 and the drum 18 may be mounted in the cabinet 12 such that the drum 18 may rotate relative to the tub 16. At least one of the tub 16 or the drum 18 define a treating chamber 20 for receiving laundry with an open face that may be selectively closed by a door 22. The rotatable drum 18 may have a plurality of perforations 48 so that liquid and/or air may flow between the tub 16 and the drum 18 through the perforations 48. The drum 18 may further include one or more baffles 50 disposed on an inner surface of the drum 18 to lift fabric items contained in the drum 18 while the drum 18 rotates. A bellows 52 may couple an open face of the tub 16 with the cabinet 12, and the door 22 seals against the bellows 52 when the door 22 closes the tub 16.

The drum 18 may be rotated by a suitable drive mechanism, which is illustrated as a motor 54 coupled to the drum 18 through a drive shaft 58. The motor may be a direct drive having a rotor 56 and a stator 57 and may be operably coupled to the controller 14 to control the rotation of the drum 18 to complete a cycle of operation. Other drive mechanisms, such as indirect drive, may also be used.

While the drum 18 is illustrated and described herein as defining the treating chamber 20, the tub 16 and/or the drum 18 may be considered a receptacle, with either of them defining the treating chamber 20 for receiving fabric items to be treated. While the illustrated washing machine 28 includes both the tub 16 and the drum 18, it is within the scope of the invention for the laundry treating appliance to include only one receptacle, with the receptacle defining the treating chamber 20 for receiving the fabric items to be treated.

The washing machine 28 of FIG. 2 may further include a liquid supply and recirculation system. Liquid, such as water or water with a wash aid, may be supplied to the washing machine 28 from a water supply 60, such as a household water supply. A first supply conduit 62 may fluidly couple the water supply 60 to a treatment dispenser 24. An inlet valve 64 may control flow of the liquid from the water supply 60 and through the first supply conduit 62 to the treatment dispenser 24. A dispensing conduit 26 may fluidly couple the treatment dispenser 24 with the tub 16.

Liquid that flows from the treatment dispenser 24 through the flow conduit 136 to the tub 16, typically enters a space between the tub 16 and the drum 18 and may flow by gravity to a sump 68 formed in part by a lower portion 70 of the tub 16. The sump 68 may also be formed by a sump conduit 72 that may fluidly couple the lower portion 70 of the tub 16 to a pump 74.

The pump 74 may direct fluid to a drain conduit 76, which may drain the liquid from the washing machine 28, or to a recirculation conduit 78, which may terminate at a recirculation inlet 80. The recirculation inlet 80 may direct the liquid from the recirculation conduit 78 into the drum 18. The recirculation inlet 80 may introduce the liquid into the drum 18 in any suitable manner, such as by spraying, dripping, or providing a steady flow of the liquid.

Still referring to FIG. 2, the washing machine 28 may include a sump heater 82 which may be located in the sump 68. The sump heater 82 may be any type of heater and is illustrated as a resistive heating element for exemplary purposes. The sump 68 may also include a one-way check valve 84 for draining any liquid in the sump 68.

The washing machine 28 may optionally include a steam generation system including a steam generator 86 that may receive liquid from the water supply 60 through a second supply conduit 90. The sump heater 82 may be used alone or in combination with a steam generator 86 to add heat to the chamber 20.

A steam conduit 92 may fluidly couple the steam generator 86 to a steam inlet 94, which may introduce steam into the tub 16. The steam that enters the tub 16 through the steam inlet 94 may subsequently enter the drum 18 through the perforations 48. Alternatively, the steam inlet 94 may be configured to introduce the steam directly into the drum 18.

The type of steam generation system is not germane to the invention and may include any type of steam generator 86 that converts liquid to steam. For example, the sump heater 82 may also be operated as a steam generator in place of or in addition to the steam generator 86.

The liquid supply and recirculation system and the steam generation system may differ from the configuration shown in FIG. 2, such as by inclusion of other valves, conduits, wash aid dispensers, and the like, to control the flow of liquid and steam through the washing machine 28 and for the introduction of more than one type of detergent/wash aid.

The washing machine 28 may further include a humidity reduction device, which is illustrated as a dehumidifying fan 30, for dehumidifying the air within the washing machine 28. The humidity reduction device 30 may be located inside or outside of the cabinet 12 and may dehumidify the air within the washing machine 28 by venting and/or supplying air from the exterior of the washing machine 28 to the tub 16. While the humidity reduction device is illustrated as a fan 30 or heater 31, the humidity reduction device may be any device capable of dehumidifying the air within the washing machine 28. It is within the scope of the invention for other types of humidity reduction devices to be used such as those discussed above with respect to the laundry treating appliance 10 and 28 illustrated in FIGS. 1 and 2.

The humidity reduction device 30 may be fluidly coupled with the tub 16 through the vent tube 33 for venting the interior of the tub 16 which includes the interior chamber 96 and the treating chamber 20. The treating chamber 20 may be fluidly coupled with the interior chamber 96 through the perforations 48 in the drum 18 such that air may flow between the two chambers.

In operation, the humidity reduction device 30 may draw in ambient air from the exterior of the washing machine 28 through the vent tube 33, as illustrated by arrows 38. The dispenser 24 may be provided such that the dispensing conduit 26 is fluidly connected with the ambient air exterior to the washing machine 28. The air flow 38 may be drawn into the tub 16 from the vent tube 33 that may be coupled with the tub 16. The air 38 drawn into the tub 16 may enter the interior chamber 96 and pass into the treating chamber 20 through the perforations 48 in the drum 18. The air may exit the treating chamber 20 in the same manner. The air may be withdrawn from the tub 16 through the dispenser 24 coupled to the dispensing conduit 26 and exhausted to the outside of the washing machine 28 through the humidity reduction device 30. The process may also be operated in reverse such that air is drawn in through the dispenser 24 and exhausted through the vent tube 33. In either manner, the dispenser 24, dispensing conduit 26, tub 16, drum 18, vent tube 33 and one or more humidity reduction device 30 provide a ventilation flow path for drawing ambient air into the tub 16 and exhausting air from the tub 16 to the exterior of the washing machine 28.

Alternatively, the routing of the air flow may be made to bypass the dispenser 24, and go from the rear of the washing machine 28, through the treatment chamber 20, and then exit to a different vent tube at the rear of the machine 28. This design may avoid restrictions to the air flow created in the dispenser 24. Also, similarly to the first embodiment, an additional inlet air (not shown) can be obtained from the cabinet 12 space, so the exit air can be vented into the cabinet 12 space instead of exiting to the exterior of the laundry washing machine 28.

As described above, the number and location of the humidity reduction device 30 may be selected to achieve the desired air flow path and level of dehumidification. One or more humidity reduction devices may be coupled with the tub 16 to ensure drying of these surfaces, as for example shown in the FIG. 2 illustrating an alternative or additional humidity reduction device in the form of the heating element 31. Additionally, the heating element 82 may also be used to add heat. However, the heating element 82 is of substantially greater wattage than the heating element 31, resulting in a much greater thermal output. Therefore, a more complex control must be used for the heating element 82 than for heating element 31.

As also described above, the washing machine 28 may include one or more door sensors 40 for detecting the door 22 opened or closed position. The one or more door sensors 40 may be any suitable type of sensor or combination of sensors capable of determining absolute or relative, i.e. displacement, door 22 positions, and may be located in any suitable location within the washing machine 28.

Figure 3:
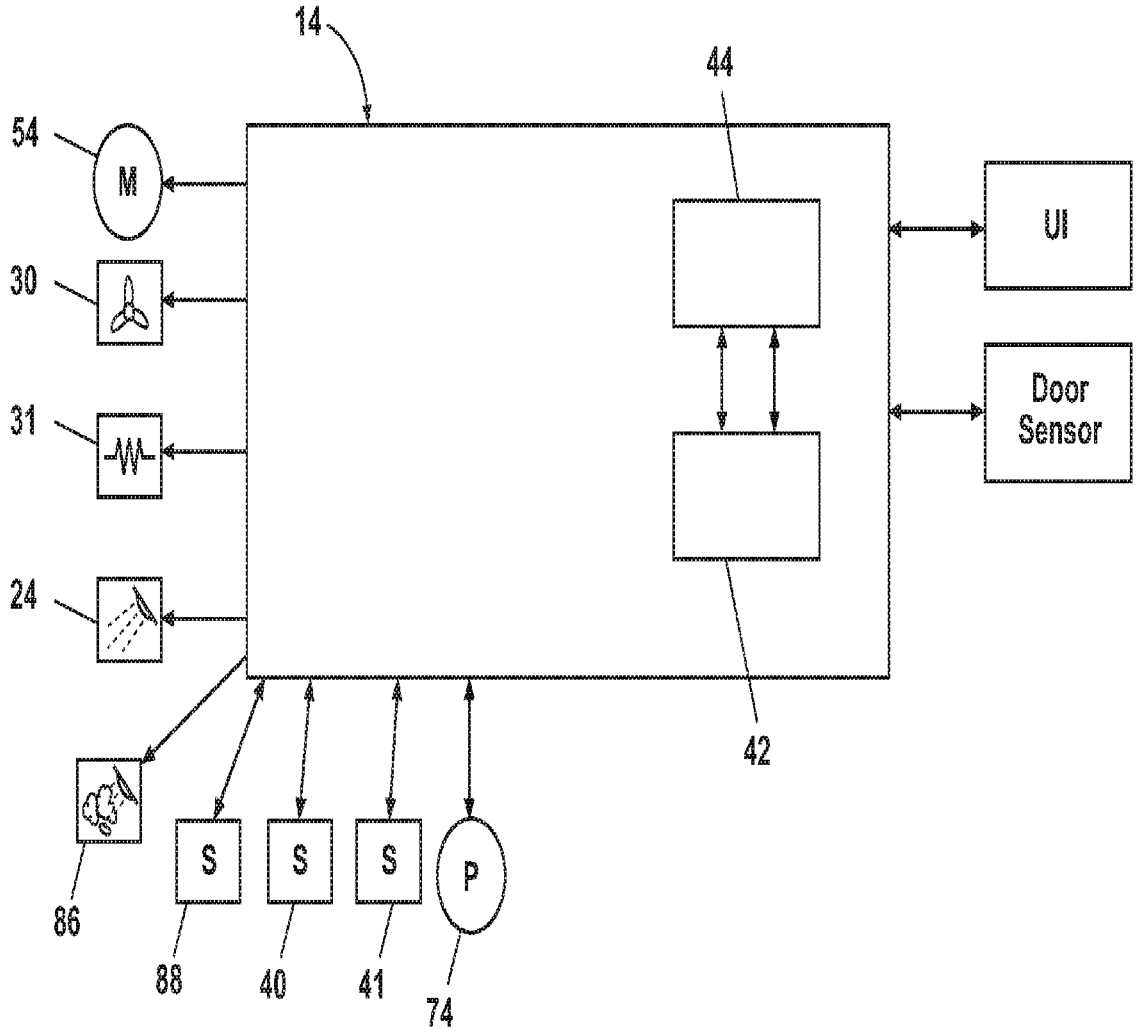
FIG. 3 is a schematic view of a control system of the laundry treating appliance of FIG. 2 according to the second embodiment.

As illustrated in FIG. 3, the controller 14 may be provided with a memory 42 and a central processing unit (CPU) 44. The memory 42 may be used for storing the control software that is executed by the CPU 44 in completing a cycle of operation using the washing machine 28 and any additional software. The memory 42 may also be used to store information, such as a database or table, and to store data received from one or more components of the washing machine 28 that may be communicably coupled with the controller 14.

The controller 14 may be operably coupled with one or more components of the washing machine 28 for communicating with and controlling the operation of the component to complete a cycle of operation. For example, the controller 14 may be coupled with the motor 54 for controlling the direction and speed of rotation of the drum 18, the treatment dispenser 24 or the steam generator 86 for dispensing a treatment during a cycle of operation, the sump heater 82 for heating the wash liquid during a cycle of operation, the pump 74 for recycling liquid from the sump 38 back to the drum 18, and the humidity reduction device. The controller 14 may also be coupled with the user interface 46 for receiving user selected inputs and communicating information to the user.

The user interface 46 may provide an option for a user to select the dehumidifying air flow direction (schematically shown by arrows 38 in FIGS. 1 and 2). The air flow direction may be from the front to the back of the washing machine 28 (for example, through the treatment dispenser 24 and out of the vent tube 33), or from the back to the front (for example, through the vent tube 33 and out of the treatment dispenser 24).

The controller 14 may also receive input from the laundry sensor 41 and/or one or more other sensors 88, which are known in the art and not shown for simplicity. Non-limiting examples of sensors 88 that may be communicably coupled with the controller 14 include: a treating chamber 20 temperature sensor, a moisture sensor, a weight sensor, and a motor torque sensor.

The controller 14 may also be coupled with the door sensor 40 for determining when the door 22 is opened and closed. The sensor reading or readings may be sent to the controller 14 and analyzed using analysis software stored in the memory 42. The controller 14 may then determine whether to activate or deactivate the humidity reduction device based on the received door 22 condition signal. For example, the controller 14 may operate the humidity reduction device to reduce the humidity in the treating chamber 20 in response to the door 22 being closed after the completion of the treating cycle of operation.

The sensors 40, 41 and/or 88 enabled to detect external environmental conditions and internal load size/type conditions may be used by the controller 14 to adjust the cycle parameters accordingly.

The previously described laundry treating appliances 10 and 28 may be used to implement one or more embodiments of a method of the invention. Several embodiments of the method will now be described in terms of the operation of the washing machine 10. While the methods are described with respect to the washing machine 28, the methods may also be used with the laundry treating appliance 10 of the first embodiment of the invention. The embodiments of the method function to automatically reduce the humidity within the treating chamber 20 and control the operation of the humidity reduction device based on the door 22 position determination.

High humidity levels, such as above 50-70% relative humidity or higher, for example, may contribute to an increase in the growth of microorganisms in the laundry and within the washing machine 28. Under normal conditions and expected standards of operation, the high humidity levels are not reached. However, on some occasions, the user may forget to remove the laundry, causing the humidity in the treating chamber 20 to reach the high humidity levels. Also, there may be some moisture within the washing machine 28 even if the user removed the laundry, but closed the door 22. The growth of these microorganisms may generate an unpleasant odor that may permeate the laundry and pervade the washing machine 28. Operation of the humidity reduction device to draw ambient air into the tub 16 and exhaust the air within the tub 16 to the exterior of the washing machine 28 may decrease the humidity of the environment within the tub 16, inhibiting the growth of these odor-producing microorganisms. The humidity reduction device may also have an additional benefit of reducing the temperature of the laundry, which also facilitates the inhibition of the growth of microorganisms.

Disclosed or additional controllers and sensors may be able to sense external environmental conditions and load size/load type and adjust the machine parameters to compensate for these conditions. For instance, if the outside environmental conditions are very dry, the predefined time associated for drying may be reduced. Furthermore, if a large load size is detected the predetermined cycle time may be automatically increased.

Figure 4:
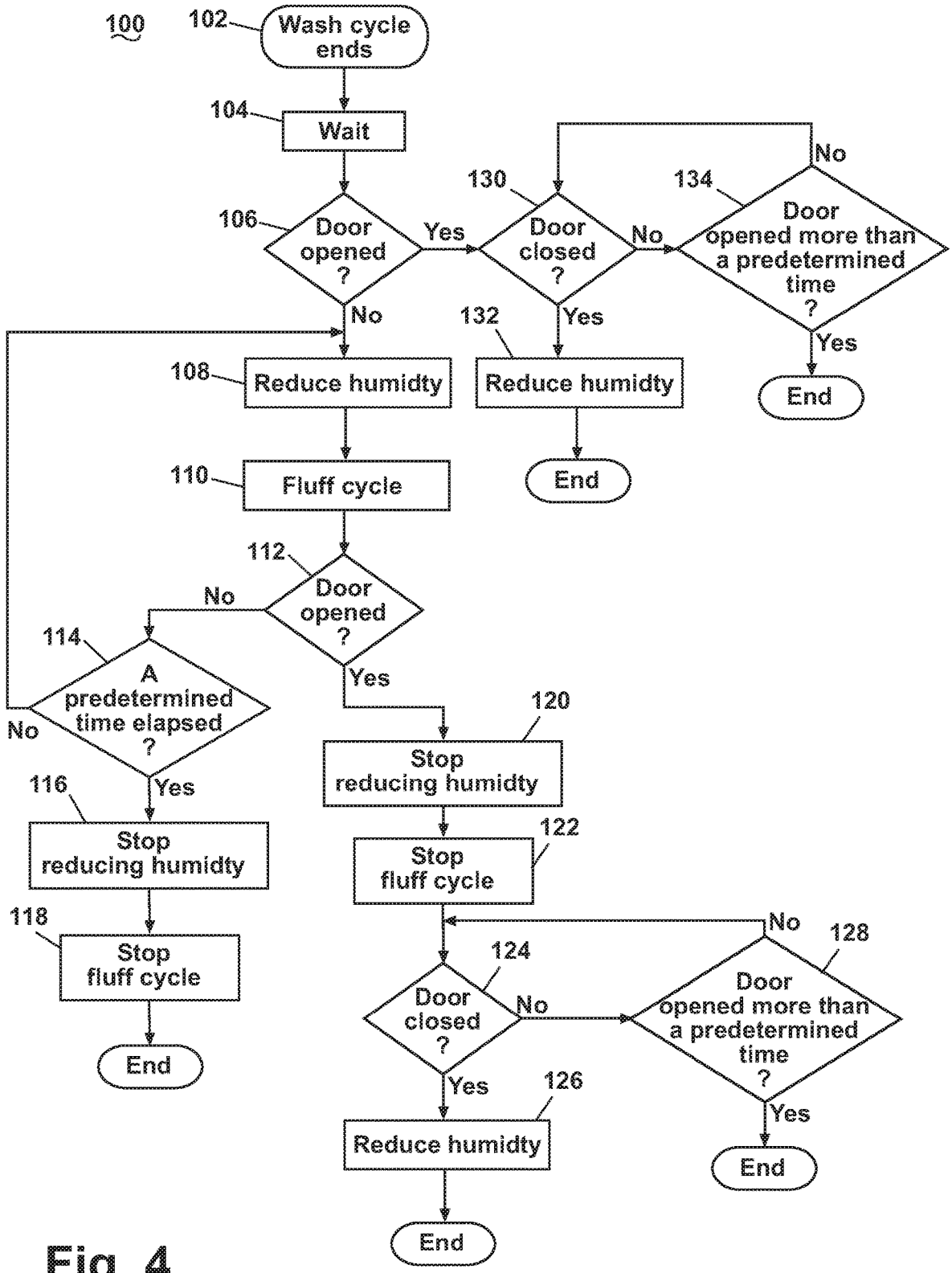
FIG. 4 is a flow chart illustrating a method for decreasing the humidity within a laundry treating appliance according to a third embodiment of the invention.

Referring now to FIG. 4, a flow chart of one embodiment of a method 100 for reducing the humidity within the treating chamber 20 is disclosed. The general approach to the method 100 is that humidity is removed in one of the two conditions: 1) after the door 22 is opened, and 2) after the door 22 is opened and then closed. It is presumed that these two conditions of the door are indicative of the removal of the laundry.

The sequence of steps depicted is for illustrative purposes only, and is not meant to limit the method 100 in any way as it is understood that the steps may proceed in a different logical order, some steps may be omitted or additional or intervening steps may be included without detracting from the invention.

The method 100 starts at 102 during the execution of a cycle of operation with an optional wait period 104. The cycle of operation may be any cycle of operation, including any one of the several well known cycles of operation, such as a wash cycle or refreshed cycle, to name a couple non-limiting examples.

The wait time at 104 may be any predetermined time including 0 minutes. A reducing humidity process at 108 and an optional fluff cycle 110 (explained in details below) may be automatically initiated by the controller 14 and may be on a predetermined schedule following an event such as determining that the door 22 was not opened at 106. More specifically, it is assumed that the laundry is removed from the treating chamber 20 upon detection of the door 22 being in the open condition at 106. Thus, if the door 22 was not opened at 106, then the laundry is assumed to still be in the chamber 20, and if the laundry is left in the chamber 20 for an extended period of time that may lead to the souring of the laundry with the corresponding unpleasant odor. To address this issue the reducing humidity process may start at 108 by activation of one or more humidity reduction device as described above. The reducing humidity process 108 and the optional fluff cycle 110 may be performed simultaneously or sequentially. The fluff cycle 110 may be omitted depending on the settings of the treating appliance 28 and/or user's preferences.

The condition of the door 22 is periodically or continuously checked at 112. If the door 22 was not opened, then a determination, if a predetermined time has elapsed, may be made at 114. If the predetermined time has elapsed, then the reducing humidity process and the optional fluff cycle may be terminated at 116 and 118 correspondingly, ending the dehumidifying cycle. If the predetermined time has not elapsed, then the reducing humidity process 108 and the optional fluff cycle 110 continue until the door 22 is opened at 112 or the predetermined time elapses.

Upon determination of the door 22 being open at 112, the reducing humidity process and the optional fluff cycle may be terminated at 120 and 122 correspondingly as it is presumed that the user is removing the laundry. A subsequent determination of the door 22 being closed may be made at 124. If the door 22 is determined to be closed at 124, then it is presumed that the laundry is removed and a reducing humidity process 126 may be performed for a predetermined time to reduce the moisture remaining in the wash chamber 20 and other parts of the washing machine 28, which may also lead to a souring and corresponding smell. If the door 22 is determined as not being closed at 124, then a check for the door to be open more than a predetermined time may be made at 128. If the door 22 is determined to be open for less than a predetermined time, then a continuous or periodical determination of the door 22 condition may be made at 124. If the door 22 is determined to be open for more than a predetermined time, then the method 100 may be ended, as it is presumed that the laundry was removed and the moisture level within washing machine 28 is substantially reduced by an air exchange though the open door.

Returning now to the door opening determination at 106, if the door 22 is determined to be open at 106, leading to the assumption that the laundry was promptly removed from the treating chamber 20, then a subsequent check of the door 22 condition may be made at 130. If the door 22 is determined to be closed at 130, then a reducing humidity process 132 may be performed for a predetermined time to reduce the moisture remaining in the assumed to be empty wash chamber 20 and other parts of the washing machine 28. If the door 22 is determined as not being closed at 130, then a check for the door to be open more than a predetermined time may be made at 134. If the door 22 is determined to be open for less than a predetermined time, then a continuous or periodical determination of the door 22 condition may be made at 130. If the door 22 is determined to be open for more than a predetermined time, than the method 100 may be ended.

Each predetermined time of 114, 126, 128, 132 and 134 may be selected individually and may be set to be different or the same. The predetermined time is selected to be long enough to reduce the humidity to a desired level. For example, the predetermined time at 128 and 134 may be set to be one hour; the predetermined time at 126 and 132 may be set to be two hours. The predetermined time for reducing the humidity may vary depending if the laundry is till in the treating chamber or was removed. Thus the predetermined time 114 may be selected to be much longer than the predetermined times 126, 128, 132 and 134, as it is assumed that the laundry was left in the treating chamber after completion of the treating cycle of operation. Other time periods may be selected for the predetermined time of 114, 126, 128, 132 and 134, based, for example, on an empirical data, technical characteristics of the treating appliance 28 and/or user preferences.

It will be understood that the door sensor 40 may work as a laundry sensor because it may be assumed that the laundry is still in the chamber 20 if the door 22 is determined to be closed after completion of the treating cycle of operation. Alternately, or additionally, if a direct determination regarding the presence of laundry is required as compared to the inferential or determination of the door opening, the determination may be made based on the information received from the laundry sensor 41, rather than based on the door 22 condition. In this case, the present invention will operate in a way similar to described above using information received only from the laundry sensor 41 or combing the information from the door sensor 40 and from the laundry sensors 41.

The method 100 may also reduce the moisture by exhausting air from the treating chamber 20 after determining a user input of a desired air flow direction. The desired air flow direction may be from the back to the front of the treating appliance 10 (illustrated by arrows 38 in FIGS. 1 and 2) or from the front to the back of the treating appliance 10 (reverse direction). Upon determination of the user input of the desired air flow direction via user interface 46, the air may be exhausted in accordance with the selected direction.

The method 100 described above, ensures a proper reduction of the moisture in both cases when the laundry is removed from the treating chamber 20 and when the laundry is left in the treating chamber 20. Moreover, an additional reducing humidity process may be performed to reduce the moisture remaining in the wash chamber 20 and other parts of the washing machine 28 after the laundry is removed from the chamber 20. In this manner, a growth of microorganisms, both within the laundry and within the laundry treating appliance system, may be inhibited.

It will be understood that the humidity reduction device may be operated to actively reduce the humidity within the washing machine 10 or 28 when the door 22 is determined to be opened and kept in the opened position. In this case, the humidity may be reduced faster further inhibiting the growth of microorganisms.

The dehumidification of the tub 16, by the humidity reduction device, may also be facilitated by removing as much liquid as possible from the tub 16 and other components of the washing machine 28. For example, the pump 144 may be activated to remove any water that accumulates in the lower portion 140 of the tub 16. In a case of a drier, there may be a one-way check valve (not shown) in the sump to drain any liquid that remains or may accumulate over time in the lower portion of the tub after the completion of a cycle of operation. The check valve may be connected with the controller 14 such that it is activated at the same time as the humidity reduction device or at the start of the method 100 illustrated in FIG. 4.

Inhibiting the growth of microorganisms through the activation of the humidity reduction device may also be facilitated by modifying existing cycles of operation or initiating additional cycles. For example, the growth of microorganisms is not only related to the humidity within the tub 16 but also to the water content of the laundry load. Existing cycles of operation may be modified such that the water content in the laundry at the end of the cycle is below a predetermined threshold value that may be determined empirically for different types of fabrics and fabric blends and stored in the controller memory 42. The decrease in laundry water content and the decrease in tub humidity may both contribute to inhibiting the growth of microorganisms. Additionally, as described above, various enabled to detect external environmental conditions and internal load size/type conditions may be used by the controller 14 to adjust the cycle parameters accordingly and also contribute to inhibiting the growth of microorganisms.

The activation of the humidity reduction device may also be combined with the optional fluff cycle. The drum 18 may be rotated continuously or intermittently clockwise and/or counterclockwise at a predetermined speed. The predetermined speed may be a constant speed or variable speed, a tumbling speed being one non-limiting example of the predetermined speed. Rotation of the drum 18, resulting in moving of the laundry load during the fluff cycle, may facilitate evaporation of liquid from the laundry by exposing more of the surface of the laundry. Evaporation of additional liquid from the laundry and subsequent removal of the humid air from the tub 16 by the humidity reduction device may decrease the growth of odor-causing microorganisms in the laundry. The rate, number, and direction of rotations of the drum 18 may be set such that the amount of mechanical damage to the load is less than the mechanical damage that occurs in the course of a cleaning cycle of operation.

The apparatus and methods described herein facilitate the inhibition of the growth of microorganisms that may generate unpleasant odors in the laundry load and laundry treating appliance. The use of door sensors to determine when to operate a dehumidifying process allows the process to be initiated based on an event, such as the door remaining closed or being opened. Known prior systems remove humidity only before the laundry is removed and do not take into account the remaining moisture in the treating chamber and in other parts of the washing machine even after the laundry is removed. For example, moisture remaining in areas such as the dispensing system or surfaces of the tub that are not normally cleaned during a wash cycle may contribute to the growth of microorganisms in the laundry treating appliance that may lead to an unpleasant odor.

The prior art system results in the dehumidifying process not being initiated to inhibit the growth of microorganisms and/or result in premature termination of the dehumidifying process before the humidity within the laundry treating appliance has been decreased to a level at which the growth of microorganisms is inhibited.

The embodiments of the invention described herein address shortcomings of prior devices. In addition, operating the humidity reduction device to ensure elimination of odor, both within the laundry and within the laundry treating appliance, may increase the lifetime of the treating appliance and ensure a greater user satisfaction.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic washing machine for treating laundry according to a treating cycle of operation, comprising:

a cabinet;

a user interface arranged on the cabinet for receiving instructions from a user of the washing machine;

a drum housed within the cabinet and configured to rotate about an axis and defining a treating chamber within the cabinet for receiving laundry to be treated;

a door for selectively providing access to the treating chamber;

a water inlet for supplying water to the treating chamber;

a fan located within the cabinet and configured to rotate to draw air from an exterior of the cabinet towards the treating chamber;

a sensor for determining the presence of laundry in the treating chamber; and a controller configured to control a plurality of cycles of operation of the washing machine, including at least one treating wash cycle where the water inlet supplies water to the treating chamber and a humidity reduction cycle without the addition of water, the controller configured to, in the humidity reduction cycle and in response to the sensor indicating the presence of laundry in the treating chamber, rotate the drum and the fan to draw air into the treating chamber.

2. The washing machine of claim 1, further comprising a vent arranged between the treating chamber and a front side of the cabinet to create an air flow path therebetween.

3. The washing machine of claim 2, wherein the fan rotates to provide air flow through the vent.

4. The washing machine of claim 2, further comprising a second vent arranged between the treating chamber and a back side of the cabinet to create a second air flow path therebetween.

5. The washing machine of claim 4, wherein the fan rotates to provide air flow through the second vent.

6. The washing machine of claim 1, wherein the sensor is a weight sensor.

7. The washing machine of claim 1, wherein the sensor is a door sensor configured to detect one of an open and closed door positions.

8. The machine of claim 7, wherein the controller is further configured to determine whether the door was opened and subsequently closed within a predefined amount of time based on the door position from the door sensor.

9. The machine of claim 7, wherein the controller is further configured to execute the humidity reduction cycle in response to the door being closed within a predefined amount of time following the door opening after the completion of the treating cycle of operation.

10. The washing machine of claim 1, wherein the controller is configured to instruct the drum to rotate during the humidity reduction cycle in one of clockwise or counterclockwise direction.

11. The washing machine of claim 10, wherein the controller is configured to instruct the drum to alternate rotation during the humidity reduction cycle between the clockwise or counterclockwise directions.

12. An automatic washing machine for treating laundry according to a treating cycle of operation, comprising:

a cabinet;

a treating chamber defined within the cabinet for receiving laundry to be treated;

a door for selectively providing access to the treating chamber;

a fan located within the cabinet and configured to rotate to draw air from an exterior of the cabinet towards the treating chamber;

a sensor for determining the presence of laundry in the treating chamber; and a controller configured to control a plurality of cycles of operation of the washing machine, including at least one treating wash cycle where a water inlet supplies water to the treating chamber and a fluff cycle without the addition of water, the controller configured to, in the fluff cycle and in response to the sensor indicating the presence of laundry in the treating chamber, rotate the drum and the fan to draw air into the treating chamber.

* * * * *